United States Patent [19]

Mahoney

[11] Patent Number: 4,566,141

[45] Date of Patent: Jan. 28, 1986

[54] SWIMMING POOL WALL CONSTRUCTION IN POOLS OF THE TYPE USING A METAL SIDE WALL

[76] Inventor: Morgan D. Mahoney, P.O. Box 69, Hastings, Ontario, Canada, K0L 1Y0

[21] Appl. No.: 501,613

[22] Filed: Jun. 6, 1983

[51] Int. Cl.[4] ..... E04H 3/18

[52] U.S. Cl. ..... 4/506; 4/513; 52/169.1; 52/169.7

[58] Field of Search ..... 4/506, 513; 52/169.1, 52/169.7; 220/73, 247

[56] References Cited

U.S. PATENT DOCUMENTS

| | | | |
|---|---|---|---|
| 588,716 | 8/1897 | Irwin | 220/73 |
| 1,308,622 | 7/1919 | Caldwell | 220/73 |
| 2,522,772 | 9/1950 | Benjamin | 220/73 X |
| 3,268,917 | 8/1966 | Diamond et al. | 4/506 X |
| 3,641,595 | 2/1972 | Viessmann | 4/506 |
| 3,648,303 | 3/1972 | Stewart et al. | 4/506 X |

FOREIGN PATENT DOCUMENTS

| | | | |
|---|---|---|---|
| 161428 | 11/1957 | Sweden | 220/73 |

*Primary Examiner*—Henry K. Artis

[57] ABSTRACT

A metal swimming pool wall is designed to extend around a pool. Metal members extend outwardly from the pool and are apertured adjacent their outer ends to be bolted or rivetted to a metal strip having corresponding apertures. By determining, at various locations about the pool, that the spacing between adjacent bolted or rivetted holes in the strip shall be longer, equal or shorter than the spacing of the wall metal member, the pool may be shaped to be concave inward, straight or convex respectively.

8 Claims, 4 Drawing Figures

SWIMMING POOL WALL CONSTRUCTION IN POOLS OF THE TYPE USING A METAL SIDE WALL

This invention relates to swimming pool wall construction in pools of the type using a metal side wall.

Such metal side walls are almost universally made of steel.

In such steel walled pools the wall may have contours as viewed in plan which are concave inward, straight, or convex inward and wherein such wall over an extent may alter its amount and sense of curvature.

It is an object of this invention to provide a longitudinally extending metal swimming pool wall having a plurality of spaced outwardly projecting members having at their outward end projecting extents generally parallel to the wall. The parallel extents are provided with apertures and such apertures are located to have a predetermined longitudinal spacing. A strip is provided having selectively spaced apertures. The strip is attached to the parallel extents by a bolt, rivet or the like by insertion through a parallel extent aperture and a strip aperture, and this means of attachment is continued along the common length of the strip and the wall. By selecting the longitudinal spacing of the strip apertures to be greater, equal or less than the longitudinal spacing of wall apertures the wall may be shaped to be concave inwards, straight or convex inward, respectively, in plan view and the strip aperture spacing may be varied along a length of strip to vary the amount or sense of curvature as and where desired.

By the terms "outward" and "inward", I refer to the sides of the pool wall which will be remote from and adjacent, respectively, the water in the pool.

By a "shank member" herein I include a bolt or rivet or any equivalent member having a shank which will pass through the aligned apertures in strip and wall and couple the strip and wall together.

The closest prior art known to applicant is as follows:

U.S. Pat. No. 3,932,969, Matras
U.S. Pat. No. 3,971,176, Rannels
U.S. Pat. No. 3,730,796, Richards
U.S. Pat. No. 3,505,765, Blaski
U.S. Pat. No. 3,247,629, Behlen
U.S. Pat. No. 1,938,024, Keeffe
U.S. Pat. No. 3,031,801, Leuthesser
U.S. Pat. No. 3,440,780, Adam
U.S. Pat. No. 3,487,600, Greene
U.S. Pat. No. 3,008,273, Widin
U.S. Pat. No. 1,153,205, Edwards
U.S. Pat. No. 2,508,128, Waards
U.S. Pat. No. 3,881,338, Tischuk It is an object of the invention to provide a swimming pool wall having attached spaced apertured extents generally parallel to and outward of the wall at planned spacing wherein the curvature of such wall is controlled by attaching an apertured strip or channel to such apertured extents with the longitudinal spacing of the apertures in the strip selected relative to the longitudinal spacing of the extent apertures to control the curvature of the wall.

It is an object of the invention to provide a selectively curved swimming pool wall wherein by forming the wall with an integral channel along the top edge, the channel including an outwardly directed span from the wall and a extent directed substantially parallel to said wall from the outer edge of the span, removing portions of said channels at planned intervals so that said wall is bendable where said portions have been removed, providing an aperture in the remaining span portion extent, such apertures being spaced when the wall is straight, and bolting or rivetting a strip to said extents using registering pairs of said extent and strip apertures to control the spacing and therefore the curvature of the wall therebetween, in plan view.

In drawings which illustrate a preferred embodiment of the invention:

FIG. 1 shows the outline of a pool having an extent A which is straight, two extents B which are concave inward and an extent C which is convex inward.

Figure 4:
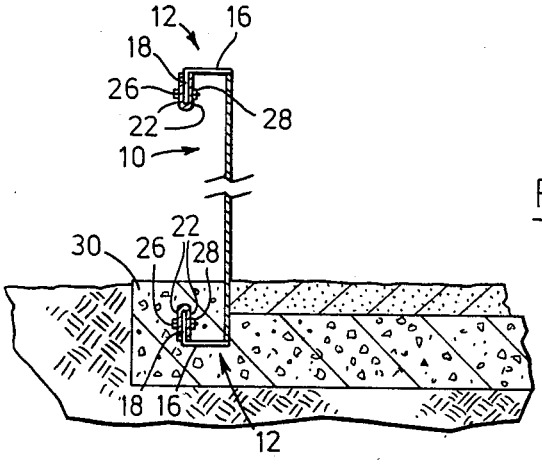
FIG. 4 is a vertical section through the pool wall perpendicular to such wall.

The sectional view, FIG. 4 shows the relationship of the components of the pool having a cement base with said thereover, a steel side wall having its lower end embedded in the concrete base and there will also be a plastic liner (not shown) for the side wall and floor.

It is the steel side wall 10 with which the invention is concerned.

The steel side wall is formed with channels 12 on the outer sides of its upper and lower edges. The channel comprises continuously extending a horizontal span which is an integral extension of the upper or lower wall, as the case may be and an extent generally directed substantially parallel to the wall formed as an integral extension of the span and wall. Preferably, and for convenience sake the upper edge extent is downwardly directed and the lower edge flange is upwardly directed to provide a neat and compact arrangement.

The channeled wall is then cut or stamped to remove extents of the channel on the upper and lower side wall at regular intevals. The result is a wall without stiffening at extents 14 where the portions have been removed and hence which is conveniently bendable to be concave or convex inward. The remaining extents of span 16 and parallel extents 18, form integrally extending horizontal and vertically directed members. The vertically directed members (i.e. parallel extents 16) are apertured to receive bolts or rivets and the apertures 20, like the extents 18 in which they are formed are regularly spaced along the wall when the latter is straight. Such spacing is indicated by the dimension S in FIGS. 2 and 3.

Figure 2:
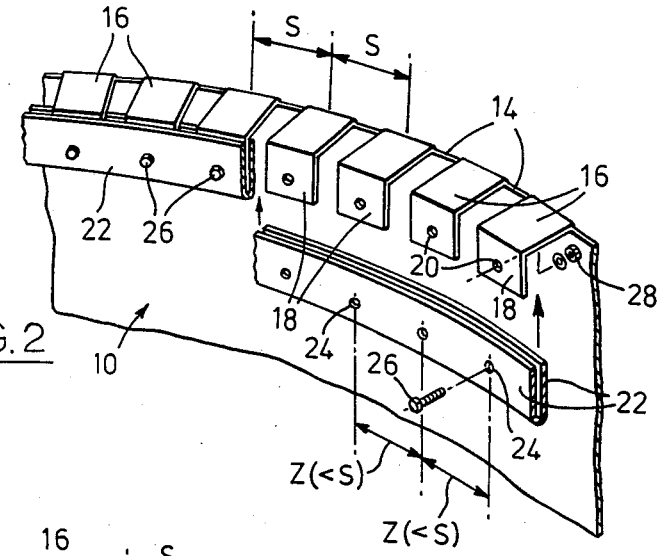
FIG. 2 is a detailed view of a convex inward extent of the pool wall.
Figure 3:
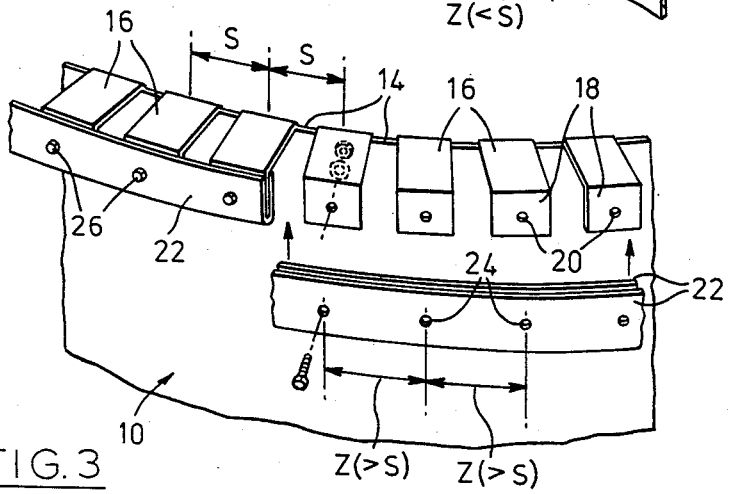
FIG. 3 is a detailed view of a concave inward extent of the pool wall.

An apertured strip is provided for coupling to the aforesaid vertical extents. This strip preferably takes the form of a channel having a pair of webs 22 joined at one edge and shaped to be hairpin shaped in section perpendicular to the web extension direction. Selectively spaced pairs of apertures 24 are provided aligned in the two webs 22 of the channel. The channel is to be applied to the vertical free extents 18 of the wall with a web 22 of the channel on each side thereof as shown in FIGS. 2–4 and with bolts 26 for coupling the channel to the free extents inserted through an aperture 24 of a web 22, the apertures 20 and the aligned aperture 24 other web and fastened with nuts 28. It will be obvious that when the longitudinal aperture spacing is the same on the channel (dimension Z) as on the wall (dimension S) extents 18, such coupling by the bolts 26 will provide a structurally reinforced wall of straight extent corresponding to extent A in FIG. 1. When the channel apertures 24 are longitudinally spaced, dimension Z, to a greater amount than the apertures in the extents 18 (dimension S) (as shown in FIG. 3) then, with the bolting as described, a curved wall is formed which is concave inward (as in extents B of FIG. 1) and the curvature varies with the amount that the aperture 24 spacing Z exceeds the wall vertical extent spacing S. (It will be noted that the 'curvature' referred to herein is inversely related to the radius of curvature). When the channel apertures 24 are longitudinally spaced to a lesser amount than the apertures 20 in the wall vertical extents $Z<S$ (as shown in FIG. 2) then, with the bolting as described, a curved wall is formed which is convex inward (as in extent C of FIG. 1) and the curvature varies with the amount that the aperture spacing is less than the wall vertical extent spacing.

The curvature may of course be gradually varied along a channel by correspondingly varying the dimension Z.

Figure 1:
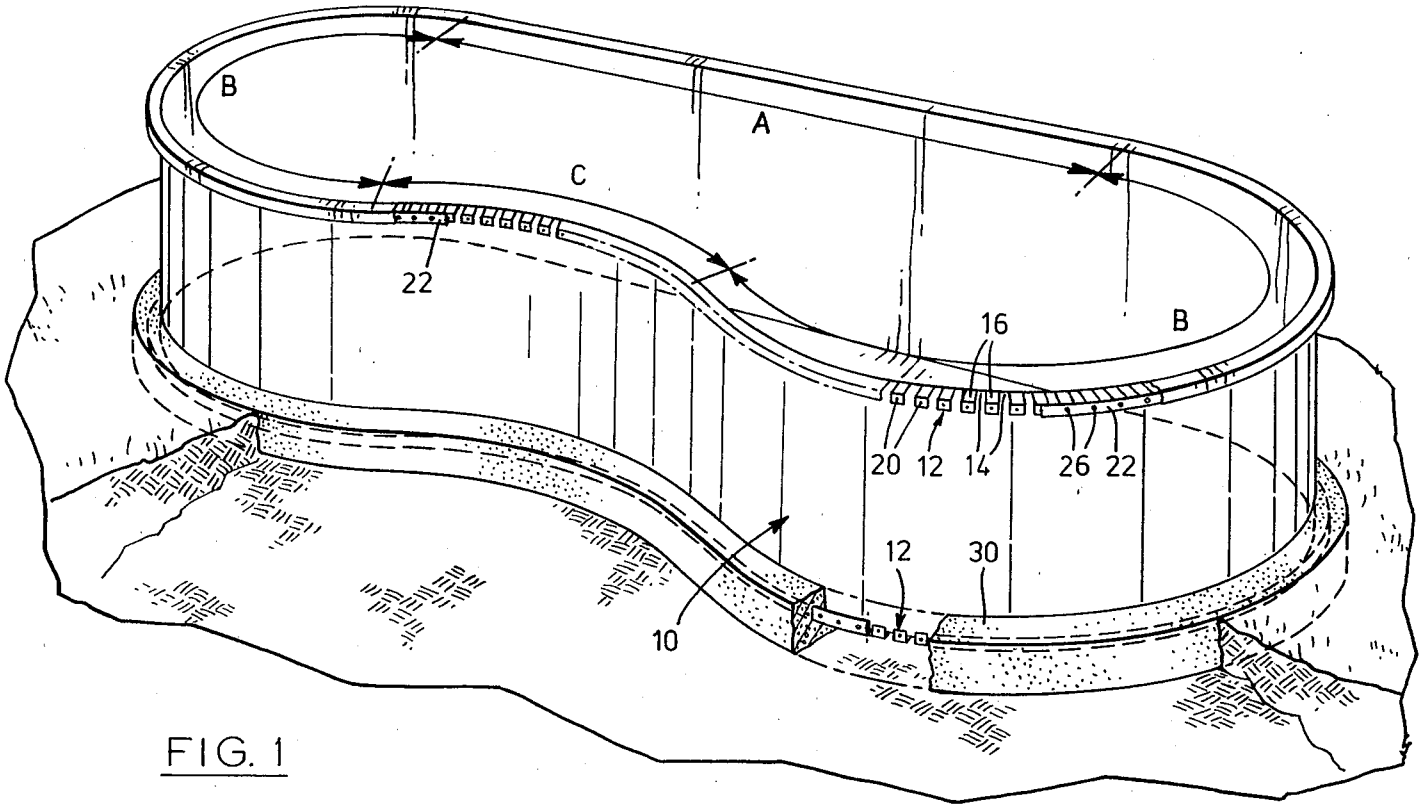
FIG. 1 is a perspective view of a pool in accord with the invention.

Although the channel coupling is shown for the top of the wall, it will be noted that a similar connection is provided at the bottom of the wall, members 18, 22 being inverted as indicated in FIGS. 1 and 4.

In the preferred embodiment the apertures on the wall vertical extents are regularly longitudinally spaced while those on the strip are varied in their longitudinal spacing to provide the sense and amount of curvature desired.

It is within the scope of the invention, although not preferred, to have the strip apertures regularly spaced and to vary the spacing of the wall-attached extents and apertures to achieve the curvature. It is also within the scope of the invention, but again not preferred to vary the spacing of both the wall extents and apertures and the strip apertures so that the curvature of the wall at a given part, is controlled to be convex or concave inwards by having at such part, the strip aperture spacing less or greater than the extent aperture spacing.

In all curvatures, or in zero curvature, the construction provides a controllably curving swimming pool wall structurally reinforced at the top and bottom by the channel. Since the lower edge of the swimming pool wall is customarily embedded in concrete 30 it is possible, to use the inventive method only on the upper edge of the wall, since the lower edge may be retained in position (and with the desired curvature) by the concrete. However, the added difficulty of maintaining the shaping of the lower wall edge while the concrete sets makes it much more efficient to use the inventive arrangement at both the top and the bottom of the wall so that the wall shape is intrinsically fixed while the concrete is applied.

A channel of hairpin shaped cross-section is preferred to a single apertured strip for coupling (by bolting rivets or similar shanked members) to the wall vertical extents 18. A single strip tends to have little if any resistance to sharp bends in its place. Thus, the single strip tends to take the attitude of a chord rather than an arc when shorter than the wall and may have a tendency to buckle (as an alternative to taking the attitude of a chord) when longer than the wall. Thus the hairpin shaped channel as shown provides a much stronger arrangement and gives a smoother curve whether at extents where the channel is longer or shorter than the wall. The smoother curve of the hairpin shaped channel allows the aperture spacing in the channel to be more predictably related to the curvature of the wall. Thus a table may be provided for manufacturing where the channel aperture spacing is related to the curvature.

I claim:

1. Swimming pool wall construction, comprising:

a metal wall for vertical disposition and designed to extend longitudinally in a horizontal direction and to define an inside and an outside relative to the pool to be enclosed by said wall, a plurality of metal members attached to said wall adjacent the upper edge thereof to extend outwardly therefrom, said members being spaced from each other in such longitudinal direction, an extent on the end of each member remote from said wall, which is substantially parallel to said wall, an aperture in each vertical extent, a metal strip, designed to extend longitudinally along said wall for attachment to said parallel extents having a plurality of spaced apertures for respective location in respective registration with said vertical extent apertures, shank members designed to pass through registering pairs of parallel extent apertures and strip apertures and to couple said extent and strip, wherein over at least a part of said wall the longitudinal spacing of said extent apertures differs from that of said strip apertures whereby the wall at such part curves in plan view, wherein said metal strip is a channel, hairpin shaped in section viewed perpendicular to said longitudinal direction, defining a pair of opposed webs, said channel being designed so that said vertical extent is received between said webs and an aperture in each of said webs is designed to register with an aperture in said parallel extent and whereby each said shank member passes through aligned apertures of one web, the vertical extent, and the other web.

2. Swimming pool wall as claimed in claim 1 wherein a second plurality of metal members is attached to said wall adjacent the lower edge thereof to extend outwardly therefrom, and a second such longitudinal apertured metal strip is coupled to said second plurality by such shanks.

3. Swimming pool wall as claimed in claim 1 wherein each of said members is an integral extension of said wall.

4. Swimming pool wall as claimed in claim 2 wherein each of said members is an integral extension of said wall.

5. Swimming pool wall as claimed in claim 1 wherein said parallel extent apertures are equally spaced from each other when the wall is flat.

6. Swimming pool wall as claimed in claim 2 wherein said parallel extent apertures are equally spaced from each other when the wall is flat.

7. Swimming pool wall as claimed in claim 3 wherein said parallel extent apertures are equally spaced from each other when the wall is flat.

8. Swimming pool wall as claimed in claim 4 wherein said parallel extent apertures are equally spaced from each other when the wall is flat.

* * * * *